US005868097A

United States Patent [19]

Spickelmire

[11] Patent Number: 5,868,097

[45] Date of Patent: Feb. 9, 1999

[54] FOLDING BOAT AND LOCKING DEVICE

[76] Inventor: James Spickelmire, 724 S. "C", Grangeville, Id. 83530

[21] Appl. No.: 991,315

[22] Filed: Dec. 16, 1997

[51] Int. Cl.[6] ..... B63B 7/00

[52] U.S. Cl. ..... 114/353

[58] Field of Search ..... 114/343, 352–354, 114/363

[56] References Cited

U.S. PATENT DOCUMENTS

| | | | |
|---|---|---|---|
| 3,996,635 | 12/1976 | Wilkes et al. | 114/352 |
| 4,522,145 | 6/1985 | Stone | 114/352 |
| 5,450,809 | 9/1995 | Melton | 114/353 |

*Primary Examiner*—Ed L. Swinehart
*Attorney, Agent, or Firm*—Wells, St. John, Roberts, Gregory & Matkin P.S.

[57] ABSTRACT

A folding boat and locking device is described in which the boat includes paired foldable hull halves joined by a hinge at transverse bulkheads. The locking device includes a rigid base member with a clamp assembly having first elongated leg members extending therefrom. Second elongated leg members also extend from the rigid base member. At least one of the leg members is movable in relation to the other leg member between an open position in which the leg members are spaced apart a first distance, and a closed position wherein the leg members are substantially parallel and spaced apart on opposed sides of the bulkheads to hold the bulkheads together. A bolt and receiver assembly mounted between the base and at least one of the leg members is selectively operable to lock the first and second leg members in the closed position. A bulkhead engaging pad is provided on at least one of the leg members, with a pad adjuster that is selectively operable to position the bulkhead engaging pad toward and away from the other leg member, thereby adjusting clamping forces against the bulkheads.

18 Claims, 7 Drawing Sheets

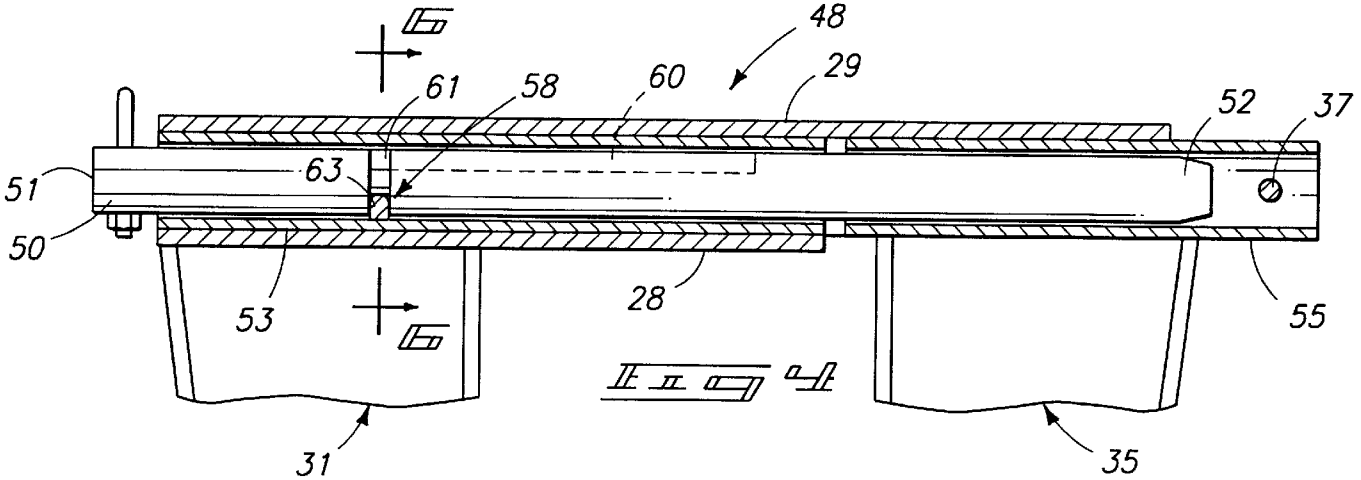
37
55
52
35
48
29
28
60
58
61
63
53
31
51
50
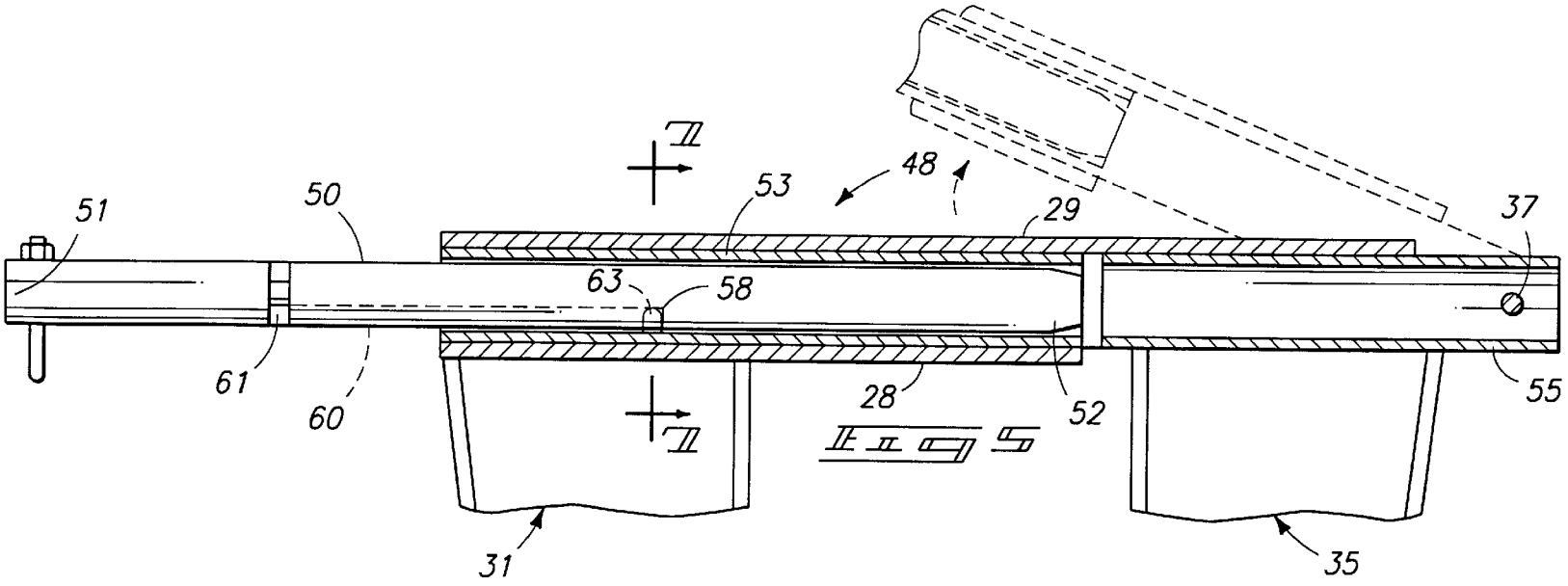
37
55
35
52
29
48
28
53
58
63
31
50
60
61
51

FOLDING BOAT AND LOCKING DEVICE

TECHNICAL FIELD

The present invention relates to foldable boat locking arrangements.

BACKGROUND OF THE INVENTION

Foldable boats are handy for sports enthusiasts who do not have the space to store full size boats, or the capability to transport a full size boat to and from waterways. Foldable boats that include relatively rigid hull sections typically fold along hinge axes that transversely bisect the boats, forming two approximately equal length halves. When folded open, the two halves are aligned end-to-end.

One form of transversely folded boat construction includes paired opposed bulkheads that are hinged along a transverse axis, usually at a midships location even with the boat gunwale.

A problem has existed in locking the hull sections in the open operative positions. The hull sections must be positively locked in the open condition or wave action will cause the halves to swing together and apart, resulting in dangerous instability.

Bolt and nut arrangements have been used to secure foldable boats in open conditions. The bolts are threaded through holes formed in the bulkheads. This arrangement is unsatisfactory since the holes for receiving the bolts will often leak unless appropriate seals are used. If the holes are located near the boat hull, as they should be to adequately hold the sections against swinging back to the closed position, very special care needs to be taken to avoid leaking.

The present folding boat and clamping arrangement eliminates the above problem by providing positive, secure locking of the folding boat halves without attendant concern for leaking. This is accomplished using the present locking arrangement which does not require holes to be formed through the bulkheads, but which instead securely clamps the bulkheads together from inside the folded open hull halves.

BRIEF DESCRIPTION OF THE DRAWINGS

Preferred embodiments of the invention are described below with reference to the following accompanying drawings.

FIG. 4 is an enlarged sectional detail view of the preferred bolt and receiver assembly in a closed, operative locked condition;

FIG. 5 is an enlarged sectional detail view of a preferred bolt and receiver assembly releasing legs of the present lock to pivot open;

FIG. 8 is illustrative of an alternate embodiment in which the hull sections are formed of metal and one leg of the lock is welded to an adjacent bulkhead.

DETAILED DESCRIPTION OF THE PREFERRED EMBODIMENTS

Figure 1:
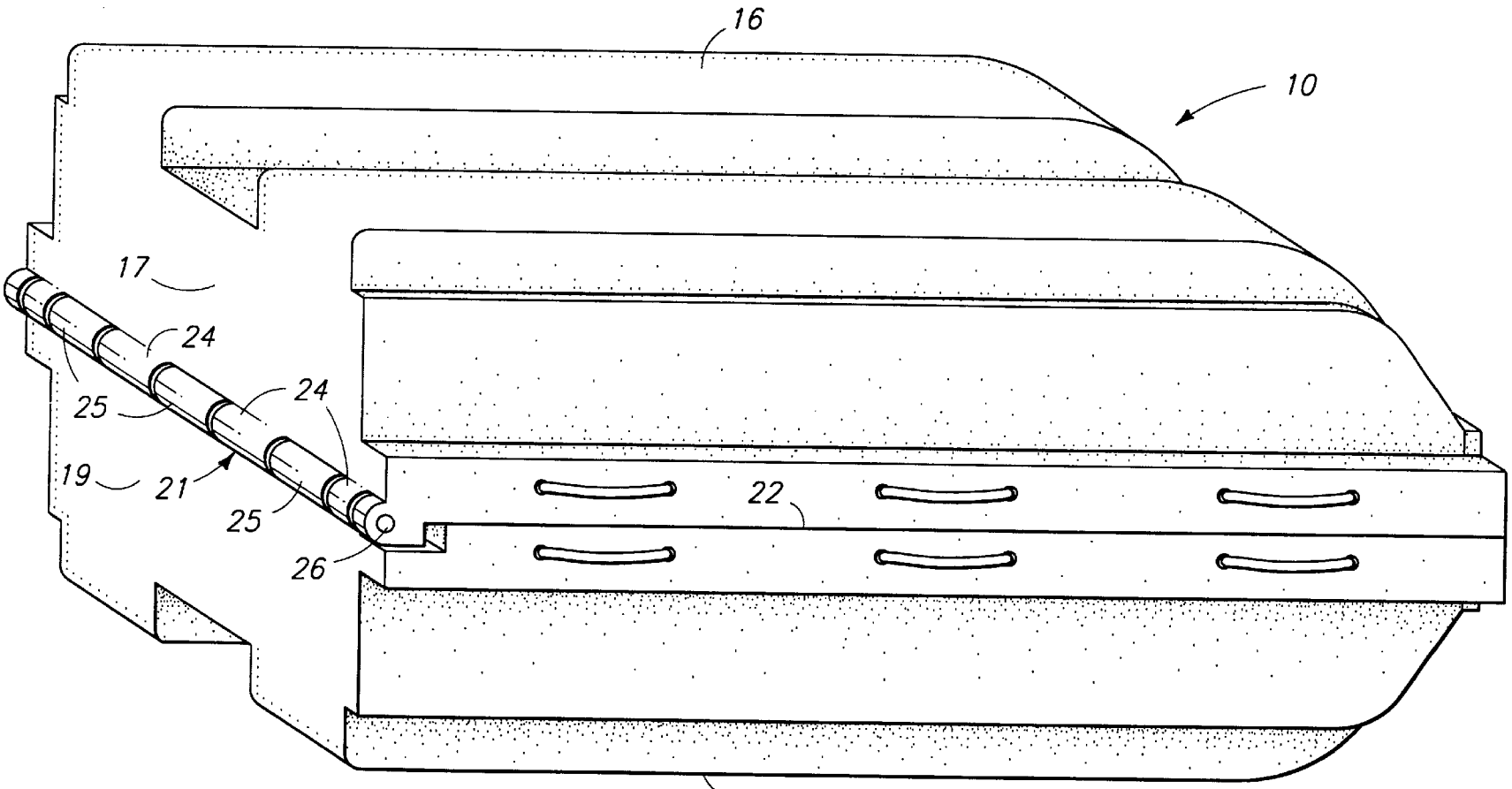
FIG. 1 is a side elevation view of a preferred foldable boat in a closed, inoperative transport or storage condition.

This disclosure of the invention is submitted in furtherance of the constitutional purposes of the U.S. Patent Laws "to promote the progress of science and useful arts" (Article 1, Section 8).

A folding boat 10 and locking device 12 are shown in the drawings as examples of preferred forms of the present invention. It is to be understood that the boat configuration may vary from that shown, and that other hull forms and sizes may incorporate aspects of the present invention. For example, the boat could take the form of a canoe, barge, rowboat or other water vessel configuration with various forms of hull configurations. The example shown lends itself well to transport and storage, and folds open to form a configuration suited for fishing, hunting or general small craft sport.

The preferred boat 10 includes a hull 14 formed in two halves, a bow half 16 and a stern half 18. The bow half includes a transverse bulkhead 17, spanning the hull to the level of the gunwales 22, and the stern half 18 includes a similar bulkhead 19 also spanning the hull and extending to the level of the gunwales 22. The two halves may be formed of any appropriate marine hull materials. In one preferred form, the hull halves are formed of a plastic such as low linear polyethylene, which is well suited for marine use and that may be formed by appropriate thermoforming processes. In an alternate preferred form (FIG. 8) the hull halves are formed of metal such as aluminum.

In the preferred boat configurations, a hinge 21 joins the two halves along the bulkheads 17, 19. The preferred hinge is configured to permit folding of the two hull halves about a transverse folding axis between an open condition (FIGS. 2 and 8) wherein the bulkheads are facing one another and spaced apart by a combined thickness dimension, and a closed condition (FIG. 1) wherein the bulkheads are pivoted apart from one another.

The hinge 21 is comprised of hinge plates 24 (FIG. 1) provided on bulkhead 17, and hinge plates 25 provided on bulkhead 19. The plates 24, 25 are situated at the level of the gunwale 22 and are formed similarly to door hinges, interleaving along the folding axis and wrapping about a transverse hinge pin 26. The two hull halves will pivot about the axis of the pin 26 at the level of the gunwale 22 between the closed condition shown in FIG. 1 and the open condition shown in FIGS. 2 and 8.

Figure 9:
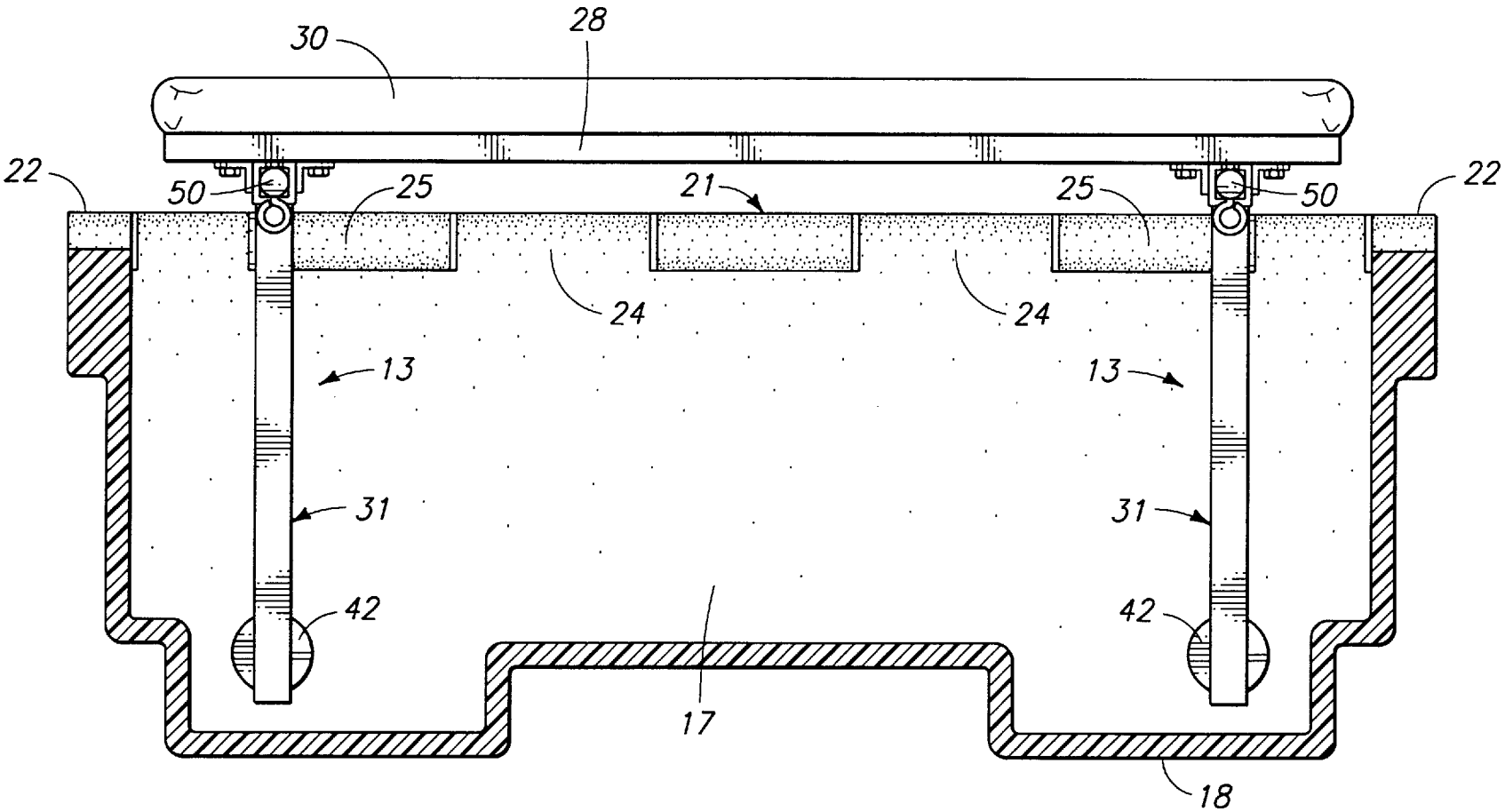
FIG. 9 is a transverse section taken along line 9—9 in FIG. 2.

The presently preferred locking device 12 is provided to selectively and securely lock the two hull halves in the open condition by clamping the bulkheads 17, 19 together. In preferred forms, at least one and more preferably at least two clamping assemblies 13 are provided on the locking device 12 (FIG. 9) to maximize stability of the craft and to assure the locking of the two hull halves in the open condition. The clamping assemblies 13 are substantially similar in construction so description of one will serve as description of the remaining assembly 13.

The preferred locking device 12 includes a rigid base member 28 that, when operational, is received across the hinge 21. The base is preferably formed of a rigid material such as aluminum, and preferably includes a flat top surface 29 that is configured to receive a seat 30, plank, or another appropriate structure that spans the width of the boat. Each of the clamp assemblies 13 is mounted to the base member 28.

Each clamping assembly 13 includes a first elongated leg member 31 that extends from the rigid base member 28 to engage one of the bulkheads. A second elongated leg member 35 also extends from the rigid base member to engage the remaining one of the bulkheads, when the hull halves are in the closed position thereof.

At least one of the leg members is movable in relation to the other leg member between an open position correlating to the closed position of the halves in which the leg members are spaced apart a first distance (dashed lines, FIG. 2), and a closed position (FIGS. 2 and 8) wherein the leg members are spaced apart by a second distance less than the first distance. The second distance is substantially equal to the combined thickness dimension of the two bulkheads. The closed position of the leg members correlates to the open position of the hull halves, where the two bulkheads are positioned adjacent one another. The leg members are substantially parallel in their closed position, and angularly separated in their open position.

Leg members 31, 35 are preferably formed of a rigid material such as aluminum, formed in elongated triangular shapes to resist bending moments produced when the boat is in use. The first leg members 31 extend from top ends 32, that are preferably secured to the base member 28 as by welding or other appropriate fastening means, to bottom ends 33. The first leg members are thus stationary relative to the base member 28.

The second leg members 35 extend from top ends 36 to bottom ends 38. The top ends are preferably pivotably connected to the base member 28 by way of pivot pins 37. The pins 37 are coaxial and define a pivot axis that is normal to the leg members 35 and substantially parallel to the bulkheads. It is also preferable that the axis of the pivot pins 37 be parallel to the hinge axis for the boat hull halves.

In the first preferred form, flanges 39 are advantageously secured to the second legs 35. Each flange 39 includes a hole formed to receive the hinge pin 26, thus securing the locking device 12 to the boat 10 and in position relative to the hinge 21 and bulkheads 17, 19. The flanges 39 are loosely received between adjacent hinge plates 24, 25.

In the alternate preferred form (FIG. 8), the second legs 35 are affixed to the bulkhead 19 along one edge 40 by welding or other appropriate fastening arrangement such as bolts or adhesives. It is also possible that the second legs 35 be formed integrally with the bulkhead 19. The device 12 is thereby mounted to the hulls without requiring the flange 39, yet the legs will remain pivotable relative to one another about the axis of pin 37.

In the first preferred form, the bottom ends 33, 38 of the leg members 31, 35 provide pads 42, 43 respectively, facing one another to engage against the respective bulkheads 17, 19 when the boat hull halves are in their open position. Adjusters 44, 45 are provided between the respective pads and leg members to facilitate adjustment of the pads toward or away from one another. The adjusters may be comprised of conventional nut and bolt combinations as shown. It is noted that in the alternate preferred form, since the leg members 35 are secured to bulkhead 19, only one pad 42 is needed on each of the first legs 31.

In preferred forms, a bolt and receiver assembly 48 is provided on each clamp assembly 13 between the base and one of the leg members. The bolt and receiver assemblies 48 are selectively operable to lock the leg members 31, 35 in their closed positions. Most preferably, each assembly 48 includes a bolt 50 formed of rigid material such as steel, slidably received within a tube 53 that is welded or otherwise secured to the base member 28. The bolt extends from an outer end 51, to a rounded or pointed inner end 52 (FIGS. 4, 5). The bolt 50 will slide in the tube 53 between an extended position, locking the associated legs in the closed position, and a retracted position releasing the legs to pivot relatively freely toward and away from one another.

The inner ends and part of the bolt lengths are slidably receivable in the extended position within elongated tubular receivers 55 that are welded or otherwise secured to the top ends 36 of the second leg members 35. The receivers 55 are positioned on the second leg members in such a manner that when the legs are in the closed position, the tubular receivers 55 are aligned with the tubes 53 and will slidably receive the bolts 50 (FIG. 4).

A keeper assembly 58 (FIGS. 4–7) is also preferred, disposed between each bolt 50 and the rigid base 28. The keeper assemblies are selectively operable to lock the bolts 50 in the extended position. Each keeper assembly preferably includes a slot 60 formed along the associated bolt 50, and a pin 63 mounted to the base member and slidably engaged in the slot. The slot 60 and pin 63 are arranged to selectively lock the bolt in the extended position. To this end, the slot 60 includes a transverse part 61 that permits the bolt 50 to be rotated, moving the longitudinal part of the slot away from alignment with the pin and thereby preventing the bolt from sliding between the extended and retracted position.

Given the above technical description, operation of the present invention may now be understood. Operation will be described in terms relating to shifting the boat from the closed condition shown in FIG. 1, to the open position shown in FIG. 2. Returning the boat from the open position to the closed position will simply involve reversal of the steps described below.

To shift the boat from the closed to the open position, the user simply shifts the hull halves 16, 18 apart. The halves 16, 18 will pivot relatively freely on the axis of the hinge 21, until the bulkheads 17, 19 come into or near abutment with one another. During this time, the locking device 12 may shift relatively independently of the boat hull halves (due to the free pivot connection between the first and second leg members 31, 35 on the pivot pins 37).

Figure 2:
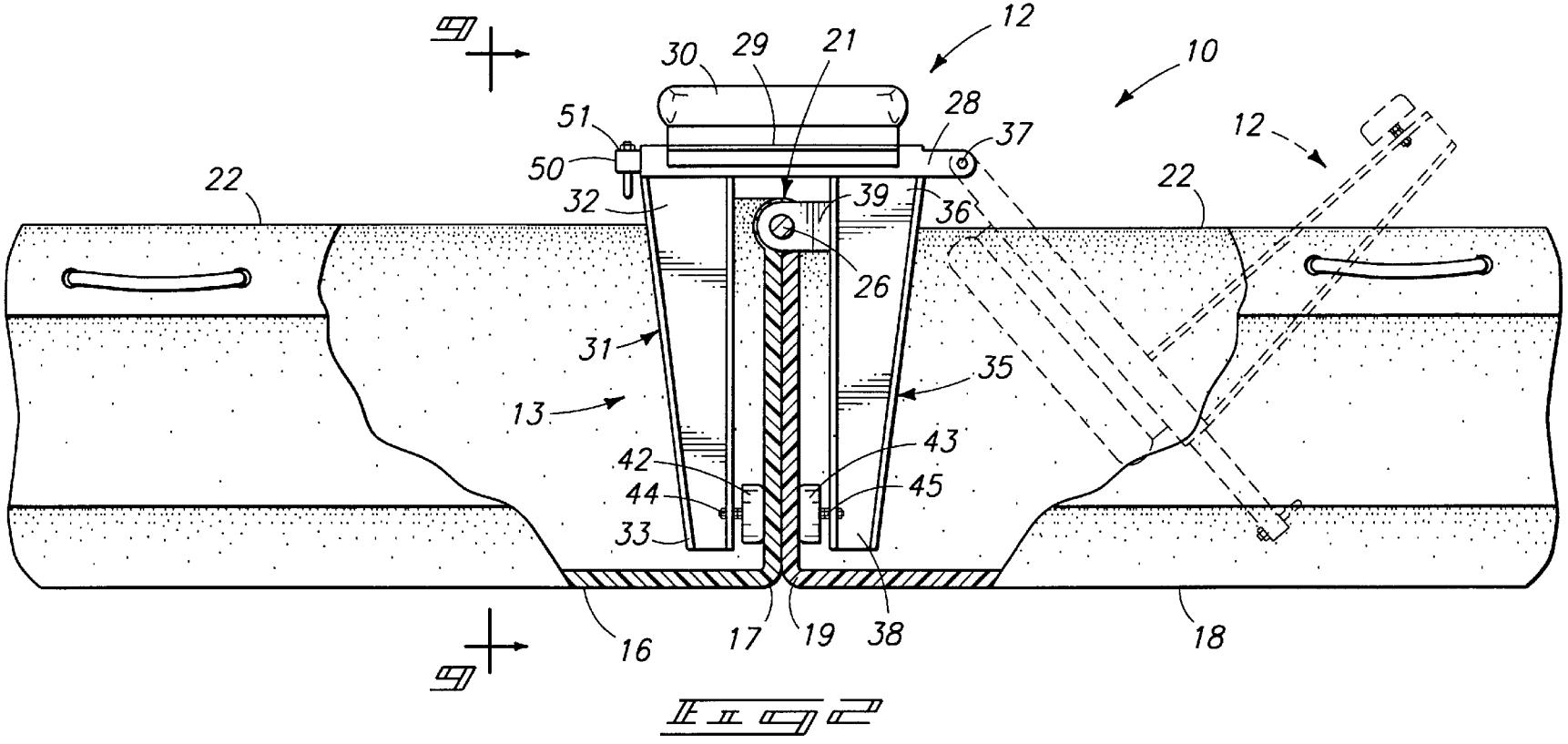
FIG. 2 is a fragmented side elevation view of the foldable boat in an open, operative position with portions of the hull sides broken away to show the preferred hinge and bulkhead arrangement.
Figure 3:
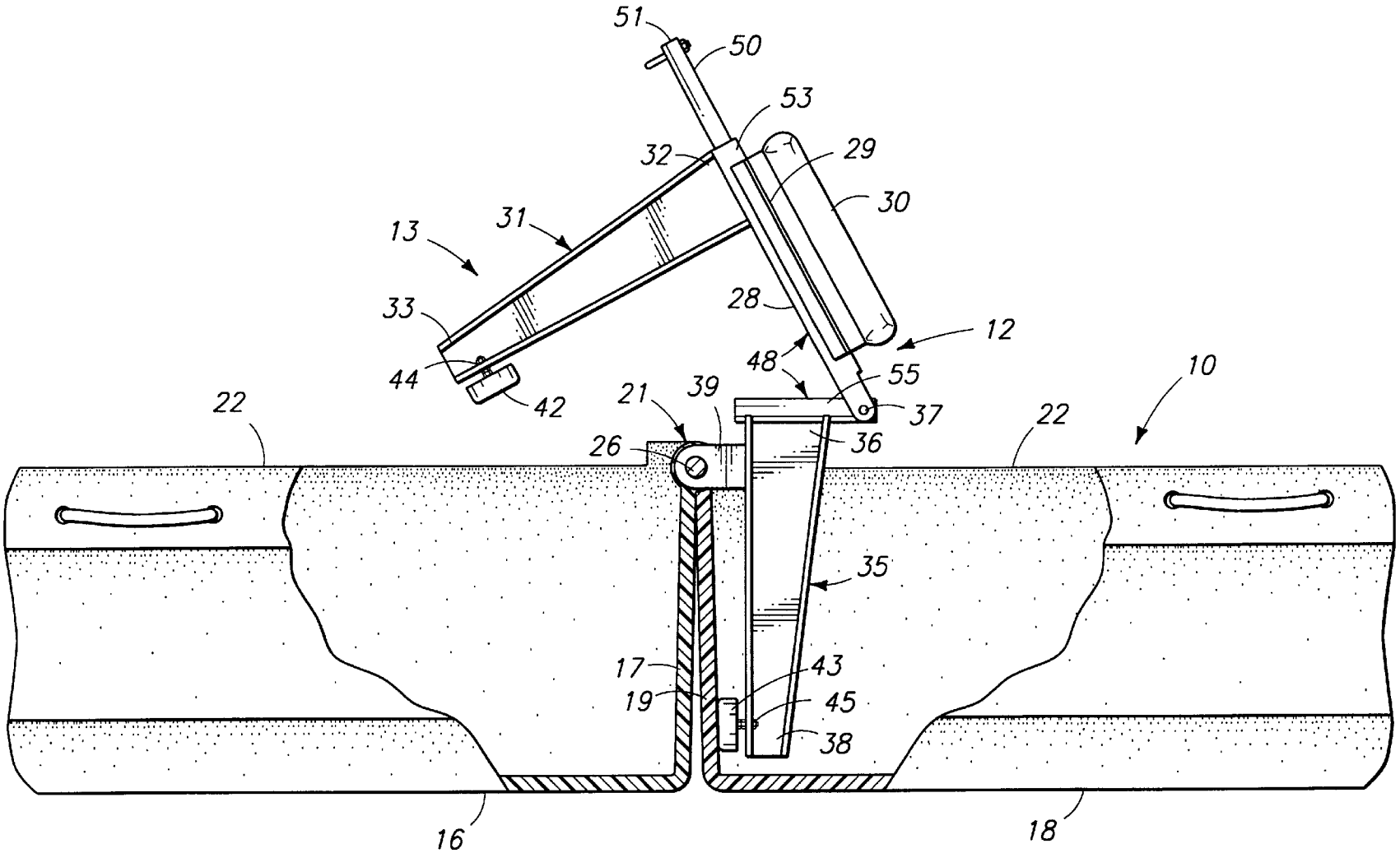
FIG. 3 is an enlarged detail view of the bulkheads and hinge in the open operative position, with the presently preferred locking arrangement in an inoperative position.
Figure 6:
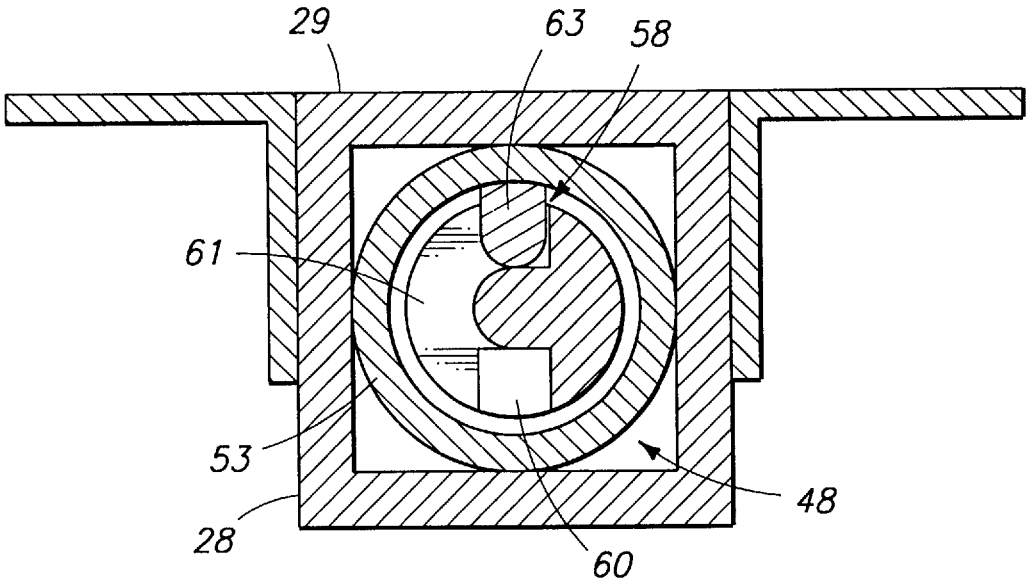
FIG. 6 is an enlarged sectional view of the bolt in a locked position, taken substantially along line 6—6 in FIG. 4.
Figure 7:
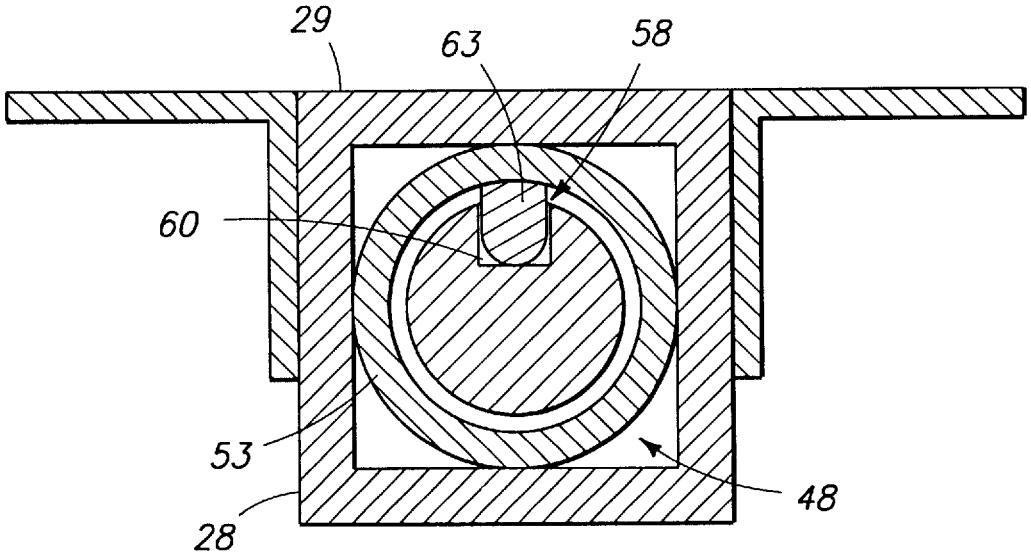
FIG. 7 is an enlarged sectional view of the bolt in an unlocked position, taken substantially along line 7—7 in FIG. 5.
Figure 6:
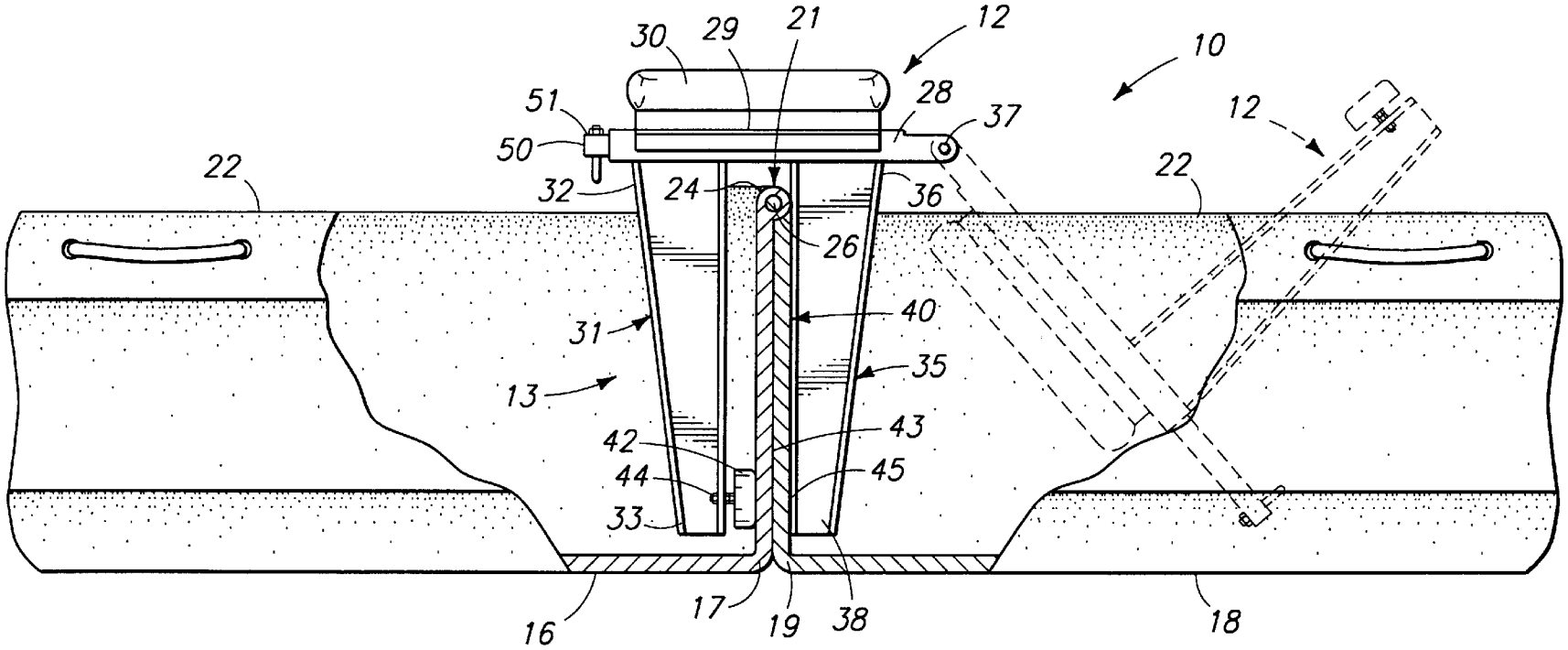

It is noted at this point that the clamp assemblies including the first leg members 31 and rigid base 28 may be situated in a storage position to one side of the bulkheads as shown by dashed lines in FIGS. 2 and 8. This pivoted, storage position is advantageous to enable the boat to be folded to a completely closed position in which the gunwales 22 are in flush abutment and the boat hull forms a closed but hollow configuration (FIG. 1).

Once the boat is opened, the first leg members 31 and rigid base 28 may be pivoted on the second leg member pivot pins 37 (which are coaxial) over the bulkheads from the position shown in dashed lines in FIG. 2 to the position shown in the same figure by solid lines. This brings the first leg members 31 into position opposite the second leg members 35, with the bulkheads 17, 19 between the pads 42, 43. The rigid base 28 is now positioned over the hinge 21 and the top surface is horizontal relative to the gunwale 22.

The bolts 50 are moved to their extended positions to lock the boat in the open position. This is done simply by pushing the bolts inwardly from the retracted position shown in FIG.

5 to the extended position shown in FIG. 4. A length of bolts is now positioned within the associated receiver 55, rigidly locking the legs on opposite sides of the bulkheads. The bolts 50 may now be turned to move the slots 60 out of alignment with the pins 63 (see FIGS. 4 and 6) to prevent accidental shifting of the bolts to the retracted position. The bulkheads (and consequently the hull halves) are thus positively locked against movement about the axis of the hinge 21 and the boat is secured and operable. If desired, the adjusters 44, 45 may be used at this time to more firmly clamp the bulkheads together. In the alternative preferred embodiment, only the adjusters on the first legs 31 are available to be used for this purpose.

It is noted that the bulkheads are clamped together from inside the hull halves. Thus it is not necessary to provide any holes through either hull half to facilitate the locking operation. Further, the hull halves are securely locked in the open position due to the geometry of the locking device, with the pads positioned a maximum distance from the hinge 21 adjacent the hull bottom, and with the locking devices elevationally secured in position relative to the hinge pin 26 by way of the flanges 39 or, in the alternate form, by the legs 35. Forces that would tend to cause the hull halves to shift toward the FIG. 1 position (such as loading of the boat when afloat), will be transferred along the hull halves to the locking device, and not the bulkheads or hinge.

In compliance with the statute, the invention has been described in language more or less specific as to structural and methodical features. It is to be understood, however, that the invention is not limited to the specific features shown and described., since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A folding boat and locking device, comprising:

a boat hull formed in two halves, with each half including a transverse bulkhead;

a hinge joining the two halves along the bulkheads, configured to permit folding of the two halves about a transverse folding axis between an open condition wherein the bulkheads are facing one another and spaced apart by a combined thickness dimension, and a closed condition wherein the bulkheads are pivoted apart from one another;

a rigid base member received across the hinge;

a first elongated leg member extending from the rigid base member to engage one of the bulkheads;

a second elongated leg member extending from the rigid base member to and mounted to the other one of the bulkheads;

wherein at least one of the leg members is movable in relation to the other leg member between an open position correlating to the open position of the halves in which the leg members are spaced apart a first distance and a closed position wherein the leg members are spaced apart by a distance substantially equal to the combined thickness dimension of the two bulkheads; and a bolt and receiver assembly mounted between the base and one of the leg members and selectively operable to lock the leg members in the closed position.

2. The folding boat and locking device of claim 1, further comprising:

a bulkhead engaging pad on at least one of the leg members; and a pad adjuster on each bulkhead engaging pad, selectively operable to position the bulkhead engaging pad toward and away from said at least one leg member.

3. The folding boat and locking device of claim 1, wherein the first elongated leg member is stationary on the rigid base member; and wherein the second elongated leg member is pivotably mounted to the rigid base member.

4. The folding boat and locking device of claim 1, wherein the first elongated leg member is stationary on the rigid base member; and wherein the second elongated leg member is pivotably mounted to the rigid base member and includes a flange connected to the hinge.

5. The folding boat and locking device of claim 1, wherein the first elongated leg member is stationary on the rigid base member; and wherein the one of the elongated leg members is affixed to one of the bulkheads.

6. The folding boat and locking device of claim 1 wherein the bolt and receiver assembly is comprised of:

a bolt slidably mounted to the rigid base; and a receiver mounted on the second leg member, aligned with the bolt in the closed position and configured to receive the bolt.

7. The folding boat and locking device of claim 1 wherein the bolt and receiver assembly is comprised of:

a bolt slidably mounted to the rigid base for movement between an extended and a retracted position;

a receiver on one of the leg members positioned thereon to receive the bolt in the extended position; and a keeper assembly disposed between the bolt and rigid base and selectively operable to lock the bolt in the extended position.

8. The folding boat and locking device of claim 1 wherein the rigid base is elongated and includes a flat seat receiving top surface; and wherein the leg members project from the rigid base opposite to the flat seat receiving surface.

9. The folding boat and locking device of claim 1 wherein one of the leg members is pivotably mounted to the rigid base member for pivotal movement about an axis substantially normal to the other leg member.

10. The folding boat and locking device of claim 1 wherein the bolt and receiver assembly is comprised of:

a bolt slidably mounted to the rigid base for movement between an extended and a retracted position;

a receiver on one of the leg members positioned thereon to receive the bolt in the extended position; and a keeper assembly including a slot formed along the bolt and a pin mounted to the base member and slidably engaged in the slot, the slot and pin being arranged to selectively lock the bolt in the extended position.

11. A folding boat locking device, comprising:

a rigid base member;

a first elongated leg member extending from the rigid base member;

a second elongated leg member extending from the rigid base member;

wherein at least one of the leg members is movable in relation to the other leg member between an open position in which the leg members are spaced apart a first distance and a closed position wherein the leg members are spaced apart by a distance less than the first distance;

a bolt and receiver assembly mounted between the base and one of the leg members and selectively operable to lock the leg members in the closed position;

a bulkhead engaging pad on at least one of the leg members; and a pad adjuster on each bulkhead engaging pad, selectively operable to position the bulkhead engaging pad toward and away from said at least one leg member.

12. The folding boat locking device of claim 11 wherein the first elongated leg member is stationary on the rigid base member; and wherein the second elongated leg member is pivotably mounted to the rigid base member.

13. The folding boat locking device of claim 11 wherein the bolt and receiver assembly is comprised of:

a bolt slidably mounted to the rigid base; and a receiver mounted on the second leg member, aligned with the bolt in the closed position and configured to receive the bolt.

14. The folding boat locking device of claim 11 wherein the bolt and receiver assembly is comprised of:

a bolt slidably mounted to the rigid base for movement between an extended and a retracted position;

a receiver on one of the leg members positioned thereon to receive the bolt in the extended position; and a keeper assembly disposed between the bolt and rigid base and selectively operable to lock the bolt in the extended position.

15. The folding boat locking device of claim 11 wherein the bolt and receiver assembly is comprised of:

a bolt slidably mounted to the rigid base for movement between an extended and a retracted position;

a receiver on one of the leg members positioned thereon to receive the bolt in the extended position; and a keeper assembly including a slot formed along the bolt and a pin mounted to the base member and slidably engaged in the slot, the slot and pin being arranged to selectively lock the bolt in the extended position.

16. The folding boat locking device of claim 11 wherein the rigid base is elongated and includes a flat seat receiving top surface; and wherein the leg members project from the rigid base opposite to the flat seat receiving surface.

17. The folding boat locking device of claim 11 wherein one of the leg members is pivotably mounted to the rigid base member for pivotal movement about an axis substantially normal to the base member.

18. A locking device for a folding boat having hull sections connected together at a pair of bulkheads, the locking device comprising:

a rigid base member;

a first elongated leg member extending from the rigid base member;

a second elongated leg member extending from the rigid base member and spaced apart from the first elongated leg member;

wherein one of the leg members is configured to be secured to one of the hull sections;

wherein the other one of the leg members is movable in relation to the one leg member between an (a) open position in which the leg members are spaced apart a first distance to enable the boat hull sections to be folded to a closed inoperative position, and (b) a closed position wherein the leg members are spaced apart to lock the bulkheads together; and a lock assembly mounted between the base and one of the leg members, selectively operable to lock the leg members in the closed position.

* * * * *